United States Patent [19]

Jeter

[11] 4,277,011

[45] Jul. 7, 1981

[54] QUICK ADJUSTING ELONGATED OBJECT GUIDE

[75] Inventor: David R. Jeter, Carrollton, Ga.

[73] Assignee: Southwire Company, Carrollton, Ga.

[21] Appl. No.: 103,754

[22] Filed: Dec. 14, 1979

[51] Int. Cl.[3] ..... B65H 23/32

[52] U.S. Cl. ..... 226/199

[58] Field of Search ..... 226/199, 196, 197, 198; 242/76

[56] References Cited

U.S. PATENT DOCUMENTS

| | | | |
|---|---|---|---|
| 2,532,563 | 12/1950 | Markle | 226/199 X |
| 2,766,041 | 10/1956 | Teplitz | 226/199 X |
| 3,026,012 | 3/1962 | Clay | 226/199 X |
| 3,318,005 | 5/1967 | Petersen | 226/199 X |
| 3,375,045 | 3/1968 | Zeidler | 226/199 X |

*Primary Examiner*—Edward J. McCarthy

*Attorney, Agent, or Firm*—Stanley L. Tate; Herbert M. Hanegan; Robert S. Linne

[57] ABSTRACT

Disclosed is an apparatus for guiding various sizes of elongated objects such as wire, cable or rod through a predetermined path in such a manner that the longitudinal axis of said elongated object conforms to the longitudinal axis of said predetermined path, said apparatus being quickly adjustable by automatic and manual means.

11 Claims, 3 Drawing Figures

QUICK ADJUSTING ELONGATED OBJECT GUIDE

BACKGROUND OF THE INVENTION

The present invention relates generally to a guide or centering device and specifically to an apparatus for centering and guiding elongated objects along a predetermined path based on a centering principle similar to those of camera shutters as disclosed in patents classified in U.S. Patent Class 95.

Many steps in the production of high quality rod, wire and cable require that the workpiece position be accurately controlled, for example, the position of a cable as it moves through an air wipe must be closely controlled if the air wipe is to function at full efficiency, likewise the conductor must be accurately positioned as it enters the cross head of an extruder if insulation is to be applied therein without causing excessive wear to the extrusion tooling and if the conductor is not to be marred during the process. A typical prior art cable centering device comprises a pair of parallel vertical rollers and a pair of parallel horizontal rollers mounted in tanden so that the pair of parallel vertical rollers control the travel of the cable within a limited vertical plane and the pair of parallel horizontal rollers control the travel of the cable within a limited horizontal plane with the results of the cooperative action of both pairs of rollers being a cable accurately positioned along a desired path. Although this prior art device is effective, it requires time consuming adjustments of all four rollers which usually involve loosening and tightening eight separate nuts, because adjustments must be made any time the cable diameter changes to assure high quality cable production.

The present invention eliminates this problem because all guiding surfaces automatically adjust to changes in cable diameter dimensions while one quick easy manual adjustment solves start-up adjustment problems.

SUMMARY OF THE INVENTION

The present invention is a quick adjusting cable guide assembly. The rear comprises a base plate with an aperture centered therethrough which serves as a cable path. Its top, bottom and side plates comprise frames which extend perpendicularly from said base plate to the front of the cable guide assembly. The front is parallel to the base plate and comprises an adjustment disc rotatably secured to the rigid top, bottom and side plates of the cable guide assembly by means of a plurality of journaling clamps along its periphery. The adjustment disc has an aperture through its center which is in line with the aperture in the base plate and cooperates with the aperture in the base plate to provide a front to back cable path through the center of the cable guide assembly.

Inside the cable guide assembly are at least three cable guide rollers spaced symmetrically around and perpendicular to and equidistant from the longitudinal axis of the cable path. Each cable guide roller is pivotally secured on one end to said base plate and the other end of each is slidably mounted in a slot in the adjustment disc which is elongated parallel to a diameter of a circle defined by the circumference of said adjustment disc and is offset therefrom by a distance at least equal to the radius of said cable guide roller. By this arrangement, rotation of the adjustment disc causes all slidably mounted ends of the cable guide rollers to cam against their respective adjustment disc slots which pivots them on the base plate either toward or away from the longitudinal axis of thecable path in unison. When the slidable ends of the cable guide rollers are at the inward portions of the adjustment disc slots the cable guide rollers are approximately tangent to the cable path causing a very small opening at the longitudinal axis of the cable path. When the slidable ends of said cable guide rollers are at the outward portions of the adjustment disc slots, the opening is largest. Since the cable guide rollers pivot in unison, they are always equidistant from the longitudinal axis of the cable path, so its longitudinal axis remains stable when cable diameter changes.

An operator's handle is provided on the adjusting disc to allow manual opening of the cable path for introduction of cable or the like. Spring tension causes a propensity for the adjustment disc to rotate toward closing. This provides automatic adjustment to changes in the diameter of cable being guided by the present invention.

Thus it is an object of the present invention to provide an apparatus for guiding elongated objects of various diameters along a predetermined path having a variable diameter and a nonvariable longitudinal axis comprising a rigid frame with a rear plate statically fixed thereto and a disc rotatably attached thereto with tensioning means, with at least three elongated object guide rollers symmetrically situated between said disc and said rear plate equidistant from said predetermined path, and pivotally secured to said rear plate by pivoting means and movably secured to said disc by sliding means further comprising reciprocating-type raceways, whereby the elongated object guide rollers have propensity to rotate in unison toward the longitudinal axis of the predetermined elongated object path to compel an elongated object passing therethrough to pass along that portion of the predetermined path which is substantially coincident to the longitudinal axis of the predetermined path.

Another object of the present invention is to provide an object guide for elongated objects which is quickly adjustable by manual means.

Still another object of the present invention is to provide an elongated object guide which is quickly and automatically self adjusting.

Yet another object of the present invention is to provide a centering device of efficient design in terms of optimum centering force, optimum opening and closing movement per rotation and pivot ration, and space savings.

BRIEF DESCRIPTION OF THE DRAWINGS

FIG. 1 is a front elevation of the preferred embodiment of the present invention in closed mode; while

DESCRIPTION OF THE PREFERRED EMBODIMENT

While the specification concludes with claims particularly pointing out and distinctly claiming the subject matter which is regarded as the invention, it is believed that the invention, objects, features and advantages thereof will be better understood from the following description taken in connection with accompanying drawings in which like parts are given like identification numerals.

Figure 1:
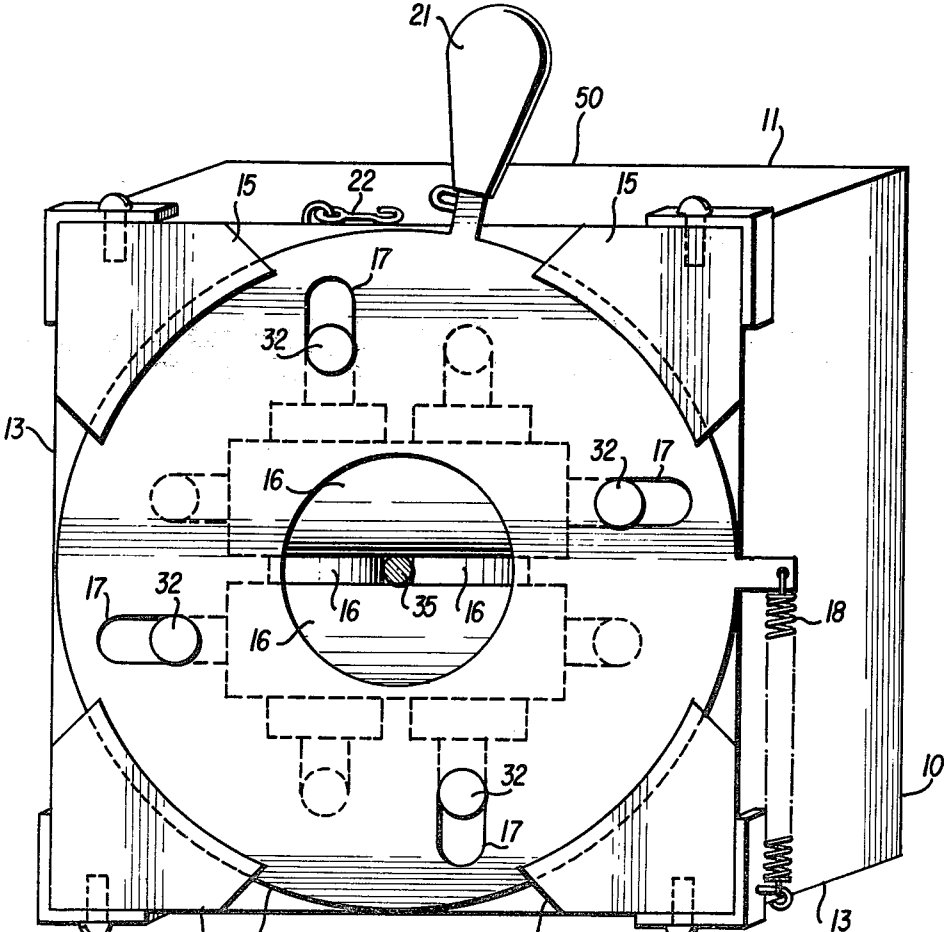

FIG. 1 generally illustrates the cable guide assembly 50 of the present invention. The rear of the present invention comprises a rear plate 10 with a centered aperture which serves as a cable exit passageway. The top 11, bottom 12 and side plates 13 comprise frames which extend perpendicularly from the rear plate 10 to the front of the cable guide assembly 50 which is parallel to said rear plate 10. The front comprises an adjustment disc 14 rotatably secured to rigid portions of cable guide assembly 50 by means of a plurality of journaling clamps 15 along its periphery. A centered aperture in said adjustment disc 14 serves as a cable entrance passageway.

Inside the present invention are at least three elongated object or cable guide rollers 16 spaced symmetrically around, equidistant from and perpendicular to the longitudinal axis 43 of a predetermined cable path having a variable diameter and a nonvariable longitudinal axis 43. Each cable guide roller 16 is pivotally secured to said rear plate 10 at a pivot point 20, FIG. 2. The other end of each cable guide roller 16 is slidably mounted in a raceway 17 in said adjustment disc 14. Each raceway 17 is elongated parallel to a diameter of a circle defined by the circumference of said adjustment disc 14 and is offset therefrom by a distance at least equal to the radius of said cable guide roller 16.

Figure 3:
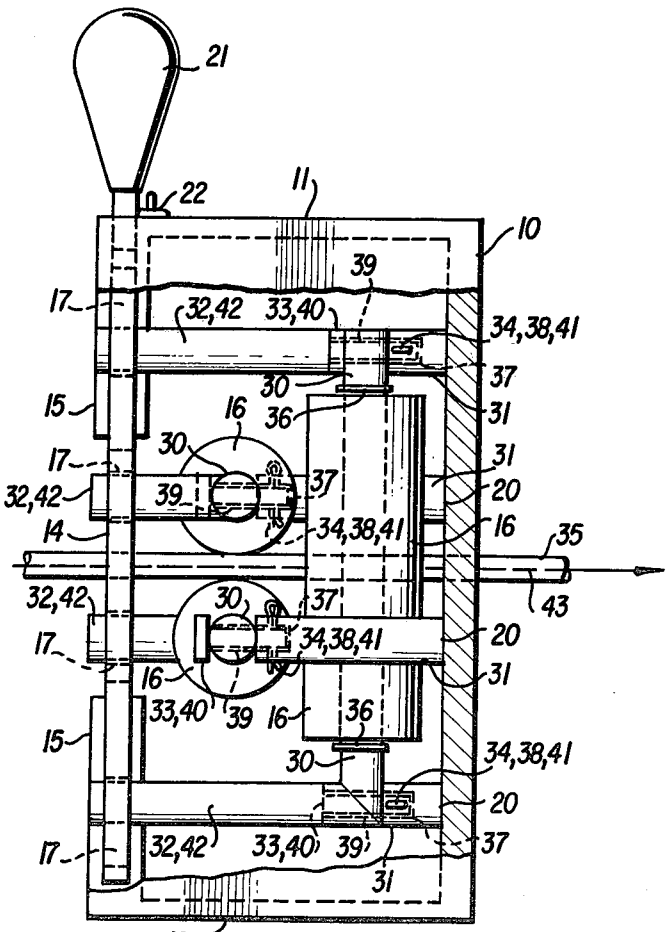
FIG. 3 is a side cross-sectional side view of the preferred embodiment of the present invention.

As previously stated, there must be at least three cable guide rollers 16. The preferred embodiment, however, contains four cable guide rollers 16 because this provides complimentary parallel cable guide rollers 16 for more efficient operation, because it is the most efficient design in terms of rotation and pivot ratio, and because such a construction is mostefficient in terms of space used. As FIG. 3 illustrates, each cable guide roller 16 is located by means of roller collars 36 on a carrier 42 comprising an axle 30, a pivoting means such as pivot shaft 31 and a sliding means such as adjustment shaft 32. Each pivot shaft 31 is secured to a pivot point 20 located on said base plate 10. A bore 37 is sunk in the inward end of said pivot shaft 31 centered along its longitudinal axis, and a duct 38 is drilled through the diameter of said pivot shaft 31 intersecting said bore 37. A cavity 39 similar to said bore 37 is drilled through the diameter of the pivoting end of said axle 30. A pivot 33 comprising a shaft slightly smaller than said cavity 39 has a keeper head 40 on one end and an aperture 41 drilled through its diameter on the other end relative to the duct 38 of said pivot shaft 31. The total length of said pivot 33 is equal to the depth of its keeper head 40 plus the diameter of said axle 30 plus the depth of said bore 37 sunk in the end of said pivot shaft 31. The shaft of said pivot 33 passes through said cavity 39 of the pivoting end of said axle 30 and into the end of said pivot shaft 31. Its aperture 41 is aligned with the duct 38 of said pivot shaft 31, and a cotter pin 34 is inserted therethrough. The ends of said cotter pin 34 are flared to assure said pivot 33 is held in place. Thus said axle 30 and said cable guide roller 16 mounted thereon are allowed to pivot around a line passing through said pivot point 20.

The other end of said axle 30 is rigidly secured at a right angle to said adjustment shaft 32. Said adjustment shaft 32 extends toward the front of the present invention and passes through a raceway 17 in said adjustment disc 14. In FIG. 3 said cable guide rollers 16 are in closed position. That is, they are in rolling contact with cable 35 passing through and being centered by the present invention because said adjustment shafts 32 are positioned toward the inwardmost ends of said raceways 17. This same closed position is reflected by FIG. 1 where said adjustment disc 14 has been rotated to near its clockwise limit by tension from a tensioning means such as an automatic adjustment spring 18 which creates a propensity for the disc 14 to rotate clockwise. This propensity for clockwise rotation has cammed said adjustment shafts 32 against the counter clockwise surfaces of said raceways 17 reciprocally moving them in unison to near their inwardmost positions which has caused said cable guide rollers 16 attached thereto by means of said carrier 42 to pivot on said pivot points 20 and enclose and center said cable 35.

Figure 2:
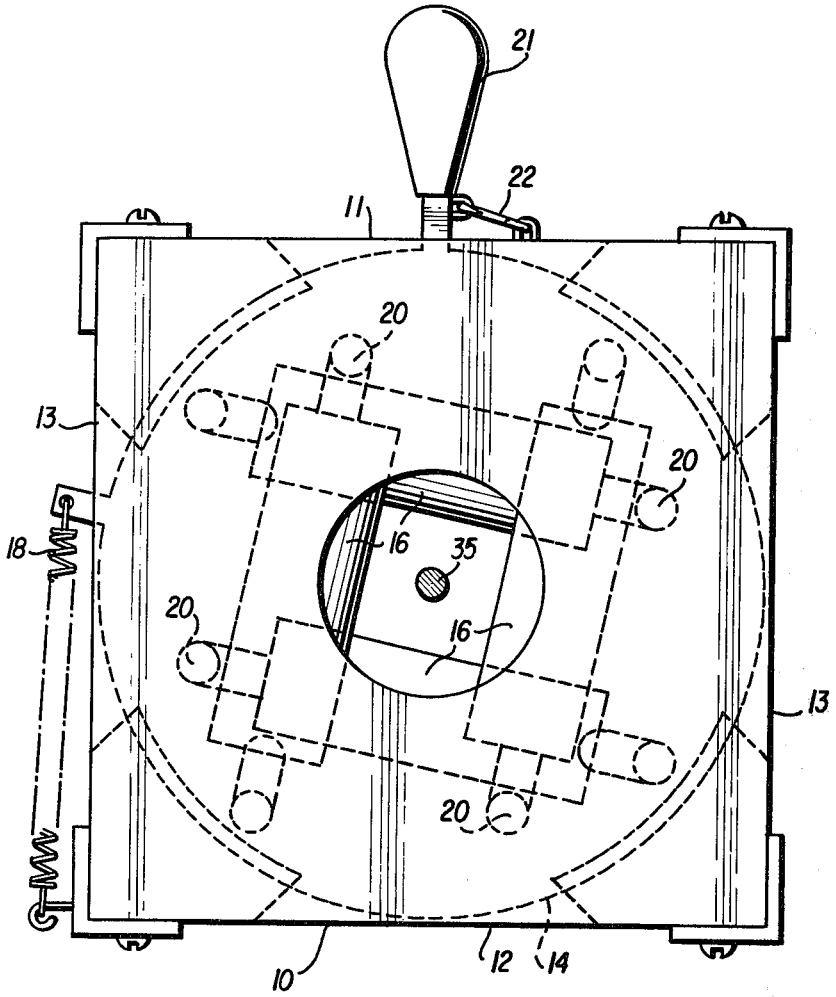
FIG. 2 is a rear view of the preferred embodiment of the present invention in open mode.

Rotation of said adjustment disc 14 in a counter clockwise direction cams said adjustment shafts 32 against clockwise surfaces of said raceways 17 moving them in unison toward their outwardmost positions which causes said cable guide rollers 16 to pivot to a full open position. FIG. 2, the rear view of the present invention, shows said adjustment disc 14 near its counter clockwise limit (clockwise in this rear view) and said cable guide rollers 16 near full open position.

A handle 21 is provided for manual adjustment by manual rotation of said adjustment disc 14. Since release of said handle 21 allows said automatic adjustment spring 18 to pull said disc 14 toward full closed position, an open position maintenance latch 22 is provided for use during start-up or for other similar reasons.

Once cable 35 begins to pass through the present invention, release of said handle 21 allows said adjustment disc 14 to rotate and said cable guide rollers 16 to pivot toward closed position until all four cable guide rollers 16 contact and center said cable 35. Since said cable guide rollers 16 pivot in unison, they are always equidistant from the longitudinal axis 43 of the cable path. Thus said cable 35 passing therebetween is compelled to pass along that portion of the predetermined path which is substantially coincident with the longitudinal axis of the predetermined path. Due to spring tension, the present invention automatically adjusts to any changes in the diameter of said cable 35.

While this invention has been described in detail with particular references to preferred embodiments thereof, it will be understood that variations and modifications can be effective within the spirit and scope of the invention as described herein before and defined in the appended claims.

What I claim as the invention is:

1. An apparatus for guiding various sizes of elongated objects through a predetermined path comprising:

a rigid frame;

a disc rotatably secured to the front of said frame and adapted to allow the continuous passage of an elongated object therethrough;

a rear plate adapted to allow the continuous passage of an elongated object therethrough secured to said frame parallel to and behind said disc, said disc and said rear plate being linearly arranged to form a predetermined elongated object path having a variable diameter and a nonvariable longitudinal axis and so arranged whereby the longitudinal axis of said elongated object path is coincident with a line drawn perpendicular to said disc and said rear plate and longitudinally through the centers of said disc and said rear plate; and at least three elongated object guide rollers of equal radius, said elongated object guide rollers being symmetrically spaced about and equidistant from the longitudinal axis of said elongated object path, movably secured to said disc by a sliding means and pivotally secured to said rear plate by a pivoting means whereby an elongated object passing along said predetermined path is compelled to pass along that portion of said predetermined path which is substantially equivalent to the longitudinal axis thereof.

2. An apparatus of claim 1 wherein said disc further comprises:

a central entrance aperture inscribed therein and circumscribing said elongated object path the diameter of which is larger than the diameter of any elongated objects passing therethrough;

a plurality of symmetrically spaced sliding means inscribed in said disc and oriented parallel to a diameter of the disc and offset from the diameter of the disc by a distance at least equal to the radius of said elongated object guide rollers which sliding means are equal in number to and serve as sliding securements for said elongated object guide rollers;

tensioning means connecting said disc to said frame in a manner whereby said disc has a propensity to rotate in a predetermined direction about the longitudinal axis of said elongated object path and whereby said elongated object guide rollers have propensity to rotate in unison toward the longitudinal axis of the predetermined elongated object path to compel an elongated object passing therethrough to pass along that portion of said predetermined path which is substantially equivalent to the longitudinal axis of said predetermined path; and a means for manually rotating said disc.

3. An apparatus of claim 1 wherein said rear plate further comprises:

a central exit aperture inscribed therein and circumscribing said elongated object path the diameter of which is larger than the diameter of any elongated objects passing therethrough; and a plurality of symmetrically spaced pivot points located equidistant from said central exit aperture which are equal in number to and serve as pivot points for said elongated object guide rollers.

4. The apparatus of claim 2 wherein said sliding means comprise raceways inscribed in said disc and adapted to receive said elongated object guide rollers and promote reciprocating motion of said elongated object guide rollers within said raceways as said disc oscillates in an arcuate path about the longitudinal axis of said elongated object path.

5. An apparatus of claim 4 wherein each of said elongated object guide rollers further comprises a roll and a roller carrier.

6. An apparatus of claim 5 wherein said said roll carrier further comprises:

an axle situated parallel to and between said disc and said rear plate;

a means for rotatably securing said roll on said axle;

a reciprocating member secured perpendicular to said axle and extending into sliding contact with said raceway; and pivoting means for attaching said axle to said rear plate, said attachment means being perpendicularly connected to said axle and to said rear plate and adapted to allow pivotal motion of said elongated object guide rollers about a discrete point along a line substantially coincident to the longitudinal axis of said attachment means.

7. An apparatus of claim 1 wherein manual or automatic rotation of said disc in the direction of propensity causes reciprocating members to cam against surfaces of said raceways opposite to the direction of propensity of said disc forcing said reciprocating members to slide in unison to the inwardmost portions of said raceways and causing said rolls to pivot on pivoting means thereby forcing said rolls in unison toward the longitudinal axis of said predetermined elongated object path.

8. An apparatus of claim 1 wherein manual or automatic rotation of said disc in a direction opposite its propensity direction causes reciprocating members to cam against surfaces of said raceways in the propensity direction of said disc forcing said reciprocating members to slide in unison to the outwardmost portions of said raceways and causing said rolls to pivot on pivoting means thereby forcing said rolls in unison away from the longitudinal axis of a predetermined elongated object path.

9. An apparatus of claim 1 including four elongated object guide rollers.

10. An apparatus of claim 9 wherein two perpendicular pairs of complimentary parallel elongated object guide rollers provide optimum centering force.

11. An apparatus of claim 9 wherein said four elongated object guide rollers provides the maximum opening and closing movement and the minimum disc rotation and roller pivot.

* * * * *